US007068238B2

(12) United States Patent
Yoneya et al.

(10) Patent No.: US 7,068,238 B2
(45) Date of Patent: Jun. 27, 2006

(54) ANTENNA DEVICE

(75) Inventors: Akira Yoneya, Akita (JP); Yoshiaki Imano, Akita (JP); Kazunari Saito, Akita (JP); Tsutomu Ito, Akita (JP)

(73) Assignee: Mitsumi Electric Co., Ltd., Tokyo (JP)

( * ) Notice: Subject to any disclaimer, the term of this patent is extended or adjusted under 35 U.S.C. 154(b) by 0 days.

(21) Appl. No.: 10/873,464

(22) Filed: Jun. 23, 2004

(65) Prior Publication Data

US 2005/0068247 A1 Mar. 31, 2005

(30) Foreign Application Priority Data

Sep. 29, 2003 (JP) ..... P. 2003-337928

(51) Int. Cl.
*H01Q 1/42* (2006.01)
*H01Q 1/12* (2006.01)
*H01B 17/26* (2006.01)

(52) U.S. Cl. ..... 343/872; 174/138 A; 174/152 A

(58) Field of Classification Search ..... 343/872, 343/873; 220/378; 174/50, 50.5, 50.54, 174/52.1–52.3, 138 A, 152 A, 153 A
See application file for complete search history.

(56) References Cited

U.S. PATENT DOCUMENTS 4,728,962 A * 3/1988 Kitsuda et al. ..... 343/872
5,531,345 A * 7/1996 Nakamura et al. ..... 220/3.8
5,585,809 A * 12/1996 Yajima et al. ..... 343/713
5,670,745 A * 9/1997 Yajima et al. ..... 174/65 R
2002/0144839 A1* 10/2002 Noro et al. ..... 174/152 G

FOREIGN PATENT DOCUMENTS

| | | | |
|---|---|---|---|
| EP | 1 033 779 | | 9/2000 |
| EP | 1 033 779 | A2 * | 9/2000 |
| EP | 1 253 665 | A2 * | 10/2002 |
| JP | 09205311 | * | 8/1997 |
| JP | 2001-068912 | * | 3/2001 |
| JP | 2001-085918 | * | 3/2001 |
| JP | 2001085918 | | 3/2001 |
| JP | 2001-68912 | | 11/2001 |

OTHER PUBLICATIONS

European Search Report dated Dec. 2, 2004.

* cited by examiner

*Primary Examiner*—Don Wong
*Assistant Examiner*—Leith Al-Nazer
(74) *Attorney, Agent, or Firm*—Whitham, Curtis, Christofferson & Cook, PC

(57) ABSTRACT

A GPS receiving antenna device that can suitably be provided on the exterior of a vehicle is provided with low cost. An antenna case includes a top cover and a bottom plate joined with each other. The top cover stores an antenna module that receives a signal and a packing member provided at the joining part between the top cover and the bottom plate to keep the antenna case tightly sealed. The top cover and the bottom plate are provided with engagement parts and claw parts, respectively, and the top cover and the bottom plate are joined with each other as the packing member is pressed.

5 Claims, 6 Drawing Sheets

ANTENNA DEVICE

BACKGROUND OF THE INVENTION

1. Field of the Invention

The invention relates to a GPS receiving antenna that receives GPS signals transmitted from a GPS satellite.

2. Description of the Related Art

In recent years, a system to receive signal waves transmitted from multiple artificial satellites that orbit around the earth by a receiver and detect the present position of the receiver based on information included in the received signal waves has come into widespread use. The system is generally called GPS (Global Positioning System) in countries including Japan and the United States of America and typically uses the GPS satellites controlled by the U.S. Department of Defense, while there are similar systems such as Galileo in Europe and Glonass in the Russian Federation. Herein, the positioning system using artificial satellites, the artificial satellites for the positioning system, signal waves transmitted from the artificial satellites, and receivers receiving the signal waves will be referred to as GPS, GPS satellites, GPS signals, and GPS receivers, respectively for ease of representation.

The GPS allows the present position of a moving body to be detected highly accurately and almost in real time, and therefore the system is primarily used for measuring the present position of a moving body such as an automobile, an airplane and a mobile telephone using a receiver provided in the moving body.

Today, GPS receivers suitable for automobiles, in other words, vehicle GPS receivers have rapidly come into widespread use. When such a GPS receiver is provided in an automobile, an antenna device for receiving a GPS signal is provided on the exterior of the automobile such as on the roof.

As shown in FIG. 7, a conventional antenna device 100 includes an antenna case 103 having a top cover 101 and a bottom plate 102 joined with each other, an antenna module 104 stored in the top cover 101, and a packing member 105 provided at the joining part between the top cover 101 and the bottom plate 102 for keeping the antenna case 103 tightly sealed, and a signal line 106 connected to the antenna module 104.

The antenna module 104 includes an antenna element 110 having an antenna for receiving a GPS signal transmitted from a GPS satellite, a circuit board 111 having a circuit for carrying out various kinds of signal processing such as signal amplification to the GPS signal received at the antenna element 110. The antenna element 110 and the circuit board 111 are joined with each other using for example a length of double-faced adhesive tape 112.

The circuit board 111 is connected with a signal line 113 for extracting the GPS signal to the outside of the antenna case 103. The circuit board 111 is provided with a shield case 114 for shielding the circuit on its surface opposite to the side of the antenna element 110. The signal line 113 is externally extended through a notch 101*a* formed in the top cover 101, and a gasket 115 is attached in a position corresponding to the notch 101*a*.

In the antenna device 100, the antenna module 104 and the packing member 105 are stored in the internal space of the top cover 101, while the top cover 101 and the bottom plate 102 are integrally joined by securing four screws 120.

The bottom plate 102 has two recesses 120*a* (only one of which is shown in FIG. 7) and a permanent magnet (not shown) is provided in each of the recesses 120*a*. These permanent magnets are provided to secure the antenna 100 to the roof of the automobile by their magnetic attraction. At the main surface of the bottom plate 102 facing the outside, a thin aluminum name plate 121 having the model number and name of the antenna device 100 and the like thereon is provided. A transparent resin sheet 122 to protect the automobile roof against damage is attached over the nameplate 121 and on about the entire surface of the main surface (see Japanese Patent Laid-Open No. 2001-68912).

Now, the conventional antenna 100 having the structure described above is produced by assembling 17 parts altogether. In recent years, there has been a demand for reduced cost in the field of such receiving antennas, and therefore the number of parts has been reduced or the assembly process has been simplified for the purpose of reducing the product cost.

In the conventional antenna device 100, the top cover 101 and the bottom plate 102 are secured by the screws 120, and therefore the boss part or rib part to secure the screws 120 to the top cover 101 and the bottom plate 102 are necessary. In the conventional antenna device 100, the space for forming these boss part and rib part should be secured, and therefore there is a limit to the size reduction of the device as a whole.

SUMMARY OF THE INVENTION

The invention has been made in view of the above-described circumstances associated with the conventional technique, and it is an object of the invention to provide an antenna device that allows the number of parts and to be reduced, the assembly process to be simplified, and the size of the device to be readily reduced.

An antenna device according to the invention receives a signal transmitted from a satellite and includes an antenna case having a top cover and a bottom plate joined with each other, an antenna module stored in the top cover for receiving the signal, and a packing member provided at a joining part between the top cover and the bottom plate for keeping the antenna case tightly sealed. The antenna case includes at least a pair of fitting parts. The fitting part includes an engagement part formed at one of the top cover and the bottom plate and a claw part fitted to the engagement part and formed at the other one of the top cover and the bottom plate. The top cover and the bottom plate are joined while the packing member is pressed by fitting the fitting parts.

In the antenna device according the invention, the top cover and the bottom plate are joined into an integral structure by fitting the fitting parts, and therefore as compared to the conventional antenna device having the top cover and the bottom plate joined by securing a number of screws, the number of parts can be reduced. In this way, the assembly process can be simplified, so that the product cost can be reduced. Since the screws for joining are not necessary, the boss part and rib part to secure the screws are not necessary in the antenna case, and the space for the boss part and rib part can be saved to reduce the size of the device as a whole.

In the antenna device according the invention, the top cover and the bottom plate are formed into an integral structure by fitting the fitting parts, and therefore as compared to the conventional antenna device having the top cover and the bottom plate joined by securing a number of screws, the number of parts can be reduced. In this way, the assembly process can be simplified, so that the product cost can be reduced. Since the screws for joining are not necessary, the boss part or rib part to secure the screws are not necessary in the antenna case, and the space for the boss part and the rib part can be saved to reduce the size of the device as a whole.

DETAILED DESCRIPTION OF THE PREFERRED EMBODIMENTS

Now, an embodiment of the invention will be described in conjunction with the accompanying drawings. In the following description, an antenna device 10 shown in FIG. 1 will be described as an application of the present invention.

Figure 1:
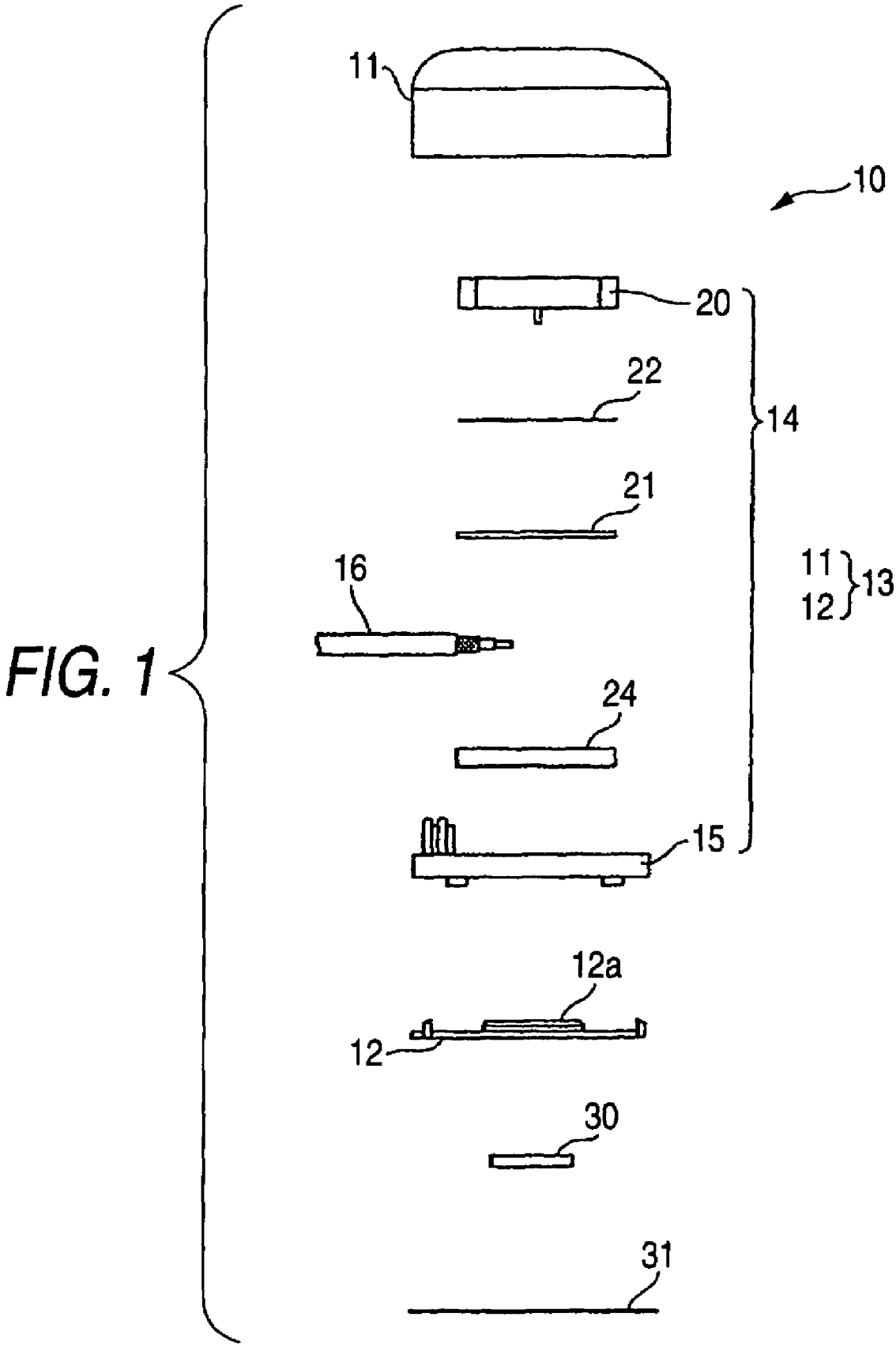
FIG. 1 is a schematic exploded view of an antenna device to which the invention is applied.

As shown in FIG. 1, the GPS receiving antenna device 10 includes an antenna case 13 having a top cover 11 and a bottom plate 12 joined with each other, an antenna module 14 stored in the top cover 11, a packing member 15 provided at the joining part between the top cover 11 and the bottom plate 12 to keep the antenna case 13 tightly sealed, and a signal line 16 connected to the antenna module 14.

The antenna module 14 has an antenna element 20 having an antenna receiving a GPS signal transmitted from a GPS satellite, and a circuit board 21 having a circuit for carrying out various kinds of signal processing including signal amplification to the GPS signal received by the antenna element 20. The antenna element 20 and the circuit board 21 are joined by a length of double-faced adhesive tape 22 or the like.

The circuit board 21 is connected with the signal line 16 used to extract GPS signals to the outside of the antenna case 13. The circuit board 21 is provided with a shield case 24 for shielding the circuit at its main surface opposite to the side of the antenna element 20. The signal line 16 is externally extended through a notch 11*a* formed in the top cover 11.

Figure 2:
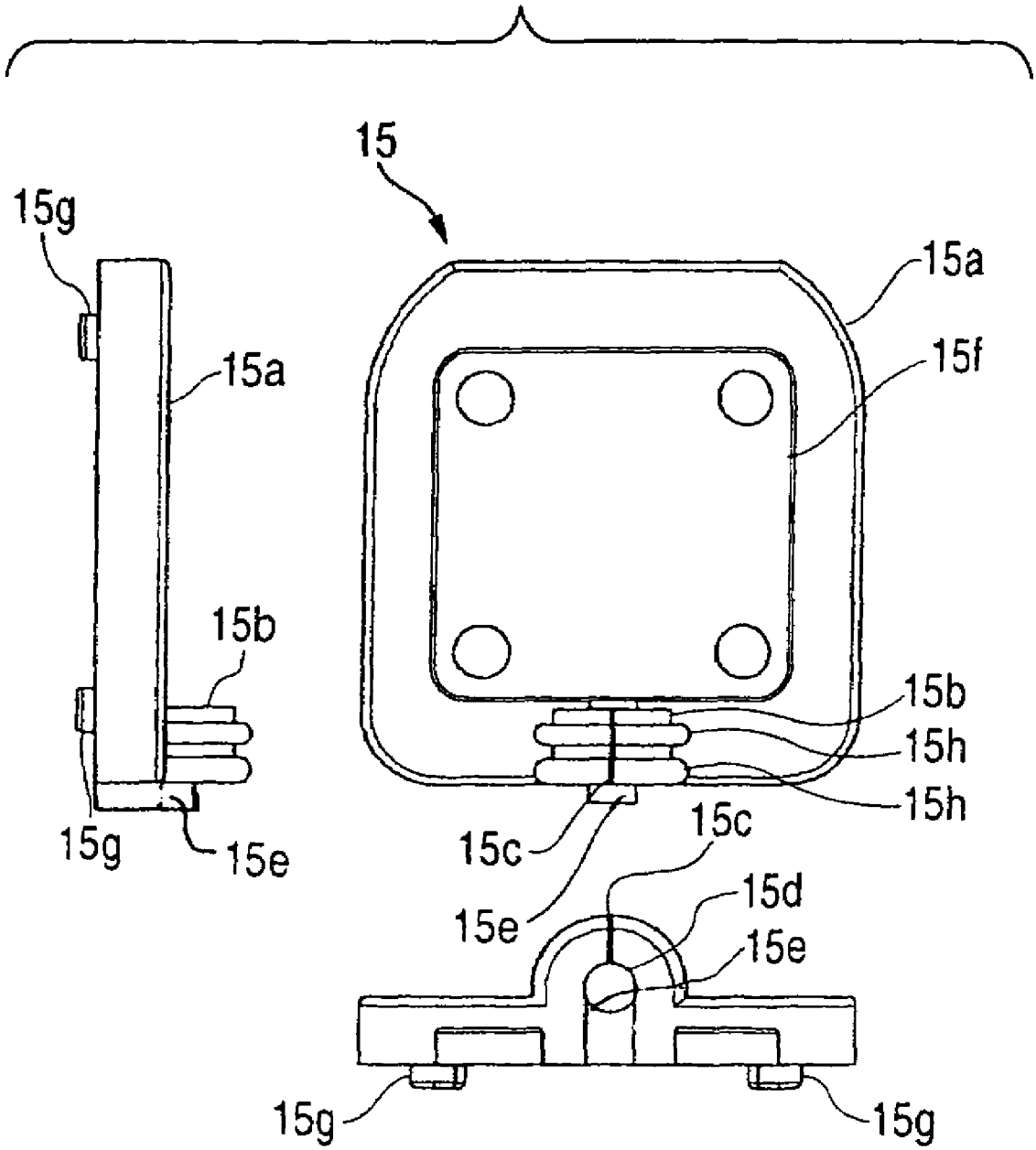
FIG. 2 is a schematic view of a packing member provided in the antenna device.

In the antenna device 10, while the antenna module 14 and the packing member 15 are stored in the internal space of the top cover 11, the top cover 11 and the bottom plate 12 are engaged with each other to be integrally joined. The packing member 15 is for example made of a resin material such as EPDM rubber and includes a base part 15*a* covering the entire surface of the antenna module 14 and a gasket part 15*b* covering the outer periphery of the signal line 16 in the position of the notch 11*a* formed in the top cover 11 as shown in FIG. 2. The base part 15*a* has a recess 15*f* that positions the antenna module 14 and has an outer shape that substantially covers the entire bottom surface of the antenna module 14.

The packing member 15 is held between the top cover 11 and the bottom plate 12 as they are joined and keeps them tightly sealed at the joining part. The gasket part 15*b* is formed as it is raised upright from the base part 15*a* in the position corresponding to the notch 11*a* of the top cover 11 and has a hole 15*d* in the center through which the signal line 16 is inserted. The gasket part 15*a* is provided with a notch 15*c* to divide the gasket part 15*b* in the direction from about the upper center of the gasket part 15*b* to the base part 15*a*.

The signal line 16 is inserted from the notch 15*c* to the hole 15*d* of the gasket part 15*b*. An extended recess 15*e* abuts against the lower side of the signal line to form a waterproof structure and is exposed to the outside from the notch ha in the top cover 11 to form a part of the surface of the antenna main body. Protrusions 15*g* are provided at the lower surface of the base part 15*a* and exposed from the bottom surface of the antenna main body through the bottom plate 12 and a resin sheet 31. The protrusions 15*g* serve to prevent the antenna main body from slipping when the antenna main body is placed on the roof of the automobile.

Figure 3:
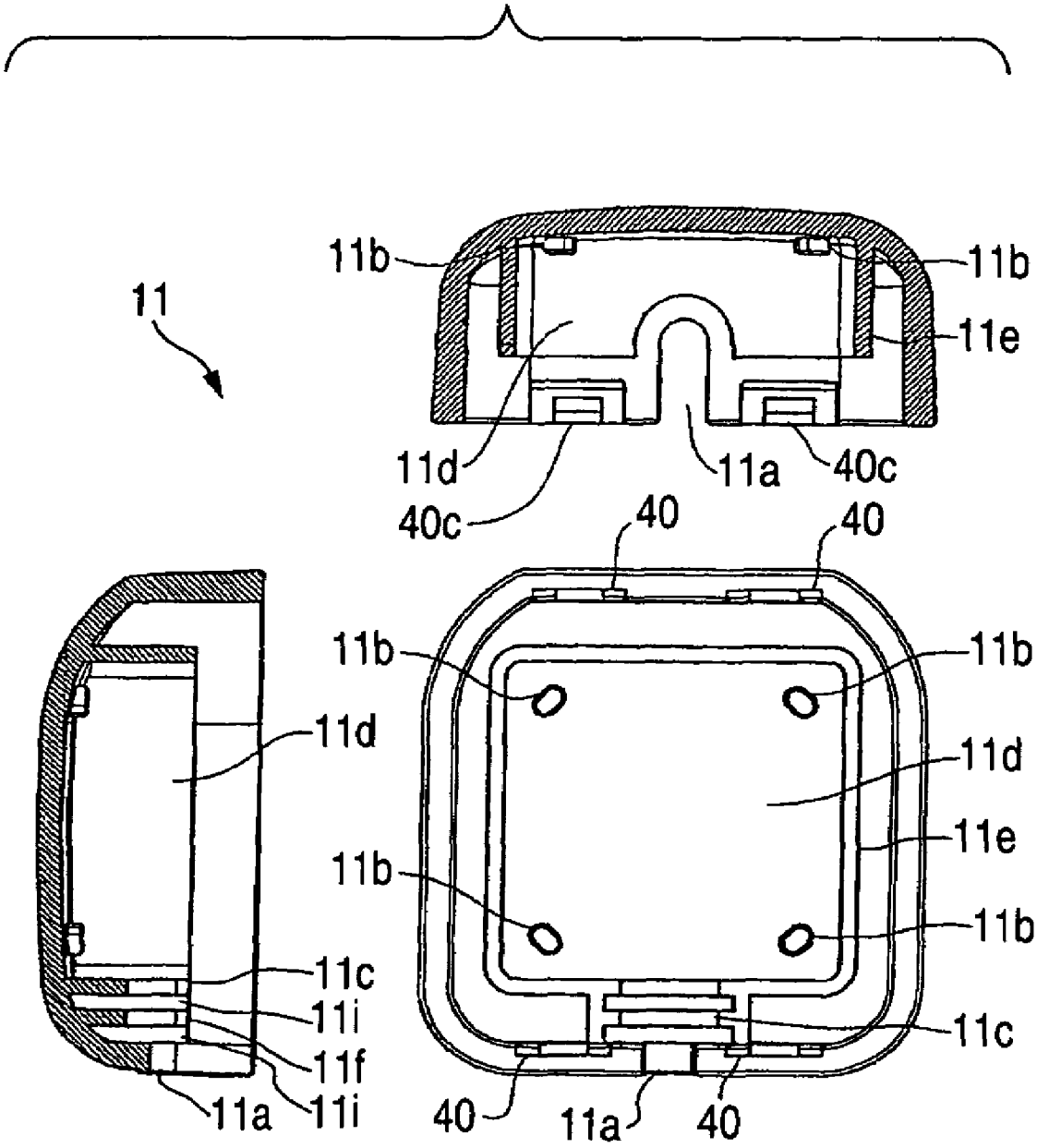
FIG. 3 is a schematic view of a top cover provided in the antenna device.

As shown in FIG. 3, the top cover 11 has a storing part 11*d* surrounded by a wall part 11*e* to store the box-shaped antenna module 14. In the storing part 11*d*, projecting members 11*b* abutting against the antenna module are provided in four locations at the inner wall of the top of the top cover 11 and integrally with the inner wall of the top cover 11. The four locations are close to the four corners of the antenna element 20.

In a gasket receiving part 11*c*, a part of a wall part 11*e* and a wall part 11*f* are arranged in two rows in the direction of the length of the signal line 16, and the circular projections 15*h* of the gasket part 15*b* are inserted into a groove 11*i* defined by the wall parts 11*e* and 11*f* and the outer wall surface of the top cover 11.

Figure 4:
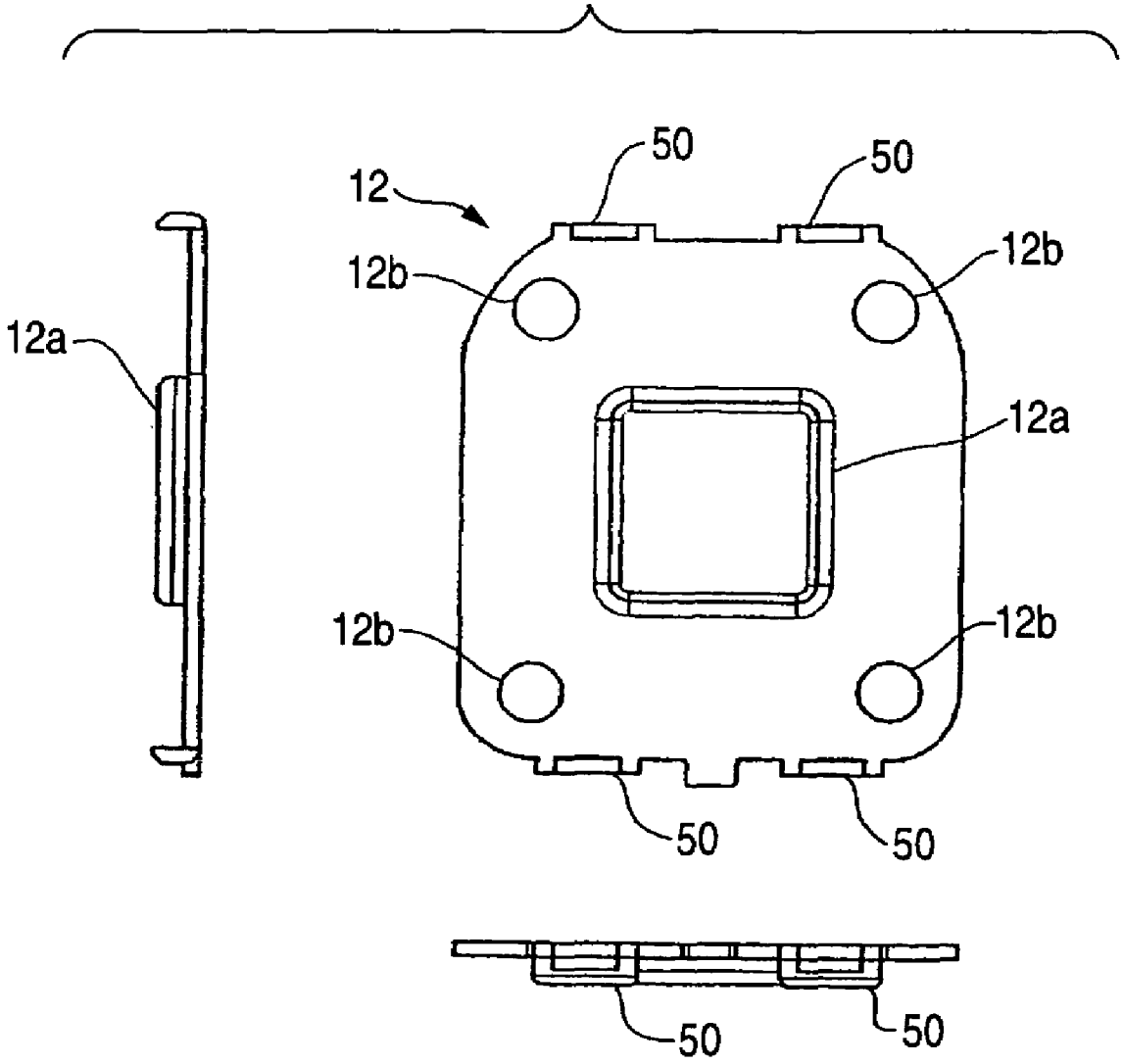
FIG. 4 is a schematic view of a bottom plate provided in the antenna device.

As shown in FIG. 4, a single recess 12*a* is formed in the center of the bottom plate 12, and a permanent magnet 30 is provided in the recess 12*a*. The permanent magnet 30 is provided to securely fix the antenna device 10 to the roof of the automobile by the magnetic attraction. The protrusion 15*g* of the packing member 15 is inserted to a hole 12*b*. The resin sheet 31 to protect the roof of the automobile against damages is provided at the main surface of the bottom plate 12 facing the outer side substantially along the entire surface. The resin sheet 31 has the model number, name and the like of the antenna device 10 printed thereon.

The antenna device 10 having the above-described structure is made of ten parts altogether.

Figure 5:
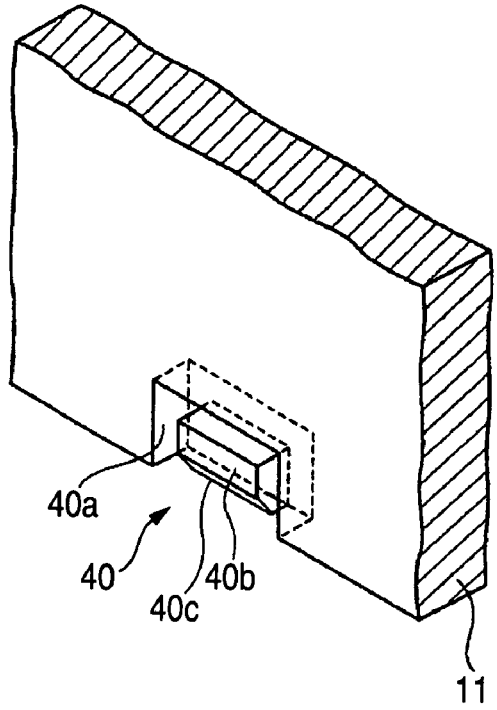
FIG. 5 is a schematic view of an engagement part provided in the antenna device.

Herein, the top cover 11 is provided with engagement parts 40 having a shape as shown in FIGS. 3 and 5 in four locations at the edge on the side to be joined with the bottom plate 12. The bottom plate 12 is provided with claws 50 having a shape as shown in FIGS. 3 and 6 in positions corresponding to the positions of the engagement parts 40 in the top cover 11.

As shown in FIGS. 3 and 5, the engagement part 40 has a shape corresponding to the outer shape of the claw 50 formed at the bottom plate 12 and is made of a recess 40*a* depressed from the inner wall surface of the top cover 11 in the same thickness and length as those of the claws 50 and an engagement member 40*b* having a raised shape with an inclined part 40*c* about in the center of the recess 40*a*.

Figure 6:
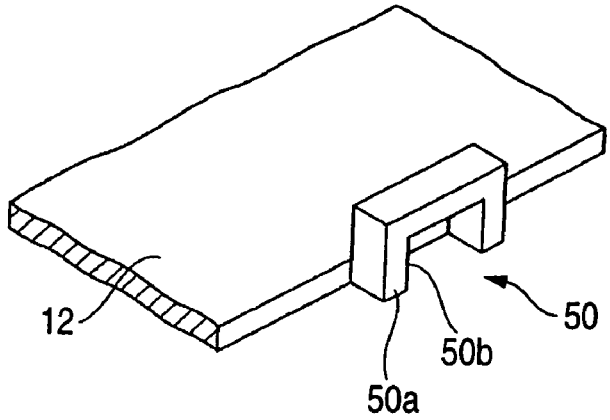
FIG. 6 is a schematic view of a claw provided in the antenna device.
Figure 7:
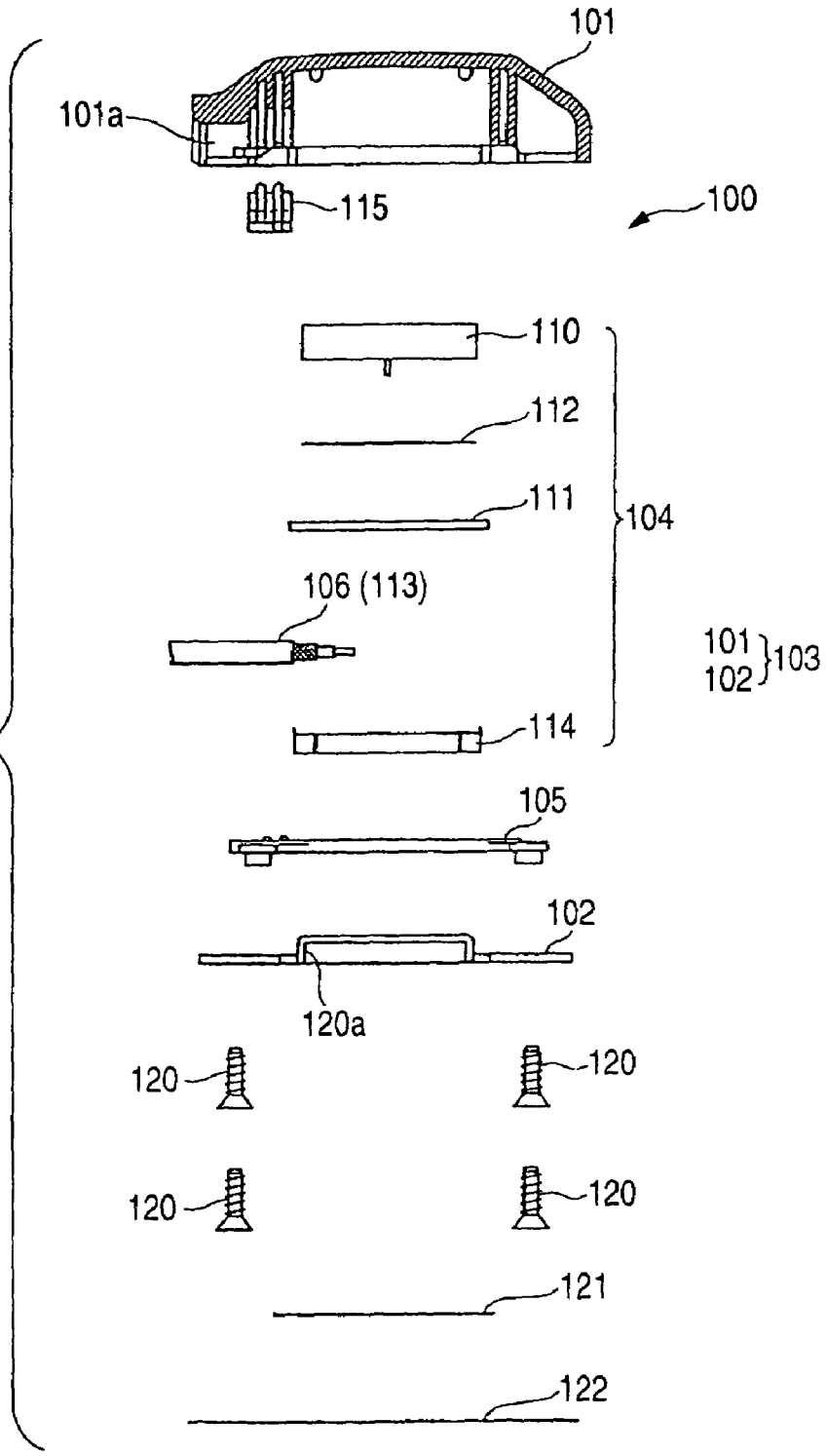
FIG. 7 PRIOR ART
FIG. 7 is a schematic exploded view of a conventional antenna device.

As shown in FIGS. 4 and 6, the claw 50 projects outwardly from the edge of the bottom plate 12 by a prescribed thickness and has an upright part 50*a* formed integrally from the bottom plate 12 to stand upright. In the center of the upright part 50*a*, a hole 50*b* large enough for the engagement member 40*b* of the engagement part 40 to engage is formed.

In the antenna device 10, the engagement parts 40 and the claws 50 having the above-described structure form a fitting part that joins the top cover 11 and the bottom plate 12. More specifically, the top cover 11 and the bottom plate 12 are joined with each other as the upright part 50*a* of the claw 50 is fitted into the recess 40*a* of the engagement part 40 while the engagement member 40*b* is engaged with the hole 50*b*. The engagement member 40*b* has the inclined part 40*c*, and therefore the engagement part 40 and the claw 50 can easily be engaged. In the GPS receiving antenna 10, while the top cover 11 and the bottom plate 12 are joined, the packing member 15 is slightly compressed by the top cover 11 and the bottom plate 12. Therefore, the compressed packing member 15 generates force to urge the top cover 11 and the bottom plate 12 away from each other. In this way, in the antenna device 10, the top cover 11 and the bottom plate 12 can surely be fitted with each other.

In the antenna device 10 as described above, the top cover 11 and the bottom plate 12 are formed into an integral structure by fitting the fitting parts 40 and 50. Therefore, as compared to the conventional antenna device having the top cover and the bottom plate joined by securing a number of screws, the number of parts can be reduced. In this way, the assembly process can be simplified, so that the product cost can be reduced. Since the screws for joining are not necessary, the boss part and rib part to secure the screws are not necessary in the antenna case, and the space for the boss part and rib part can be saved to reduce the size of the device as a whole.

Note that in the foregoing, the top cover 11 and the bottom plate 12 are provided with the four engagement parts 40 and the four claws 50, respectively by way of illustration, but an arbitrary number of such fitting parts may be provided. As long as sufficient joining strength is provided, for example only two pairs of fitting parts may be provided.

In the foregoing description, the top cover 11 and the bottom plate 12 are provided with the engagement parts 40 and the claws 50, respectively by way of illustration, but the top cover 11 may be provided with a part in a shape corresponding to the claw 50, and the bottom plate 12 may be provided with a part in a shape corresponding to the engagement part 40.

The engagement parts 40 and the claws 50 may have any arbitrary shapes different from those in FIGS. 3 to 6 as long as the top cover 11 and the bottom plate 12 can surely be joined with each other.

What is claimed is:

1. An antenna device; comprising:

an antenna module, adapted to receive a radio signal;

an antenna case, having a top case formed with a first engagement part and a bottom case formed with a second engagement part adapted to be engaged with the first engagement part to couple the bottom case to the top case to accommodate the antenna module therein; and a packing member, held between the antenna module and the bottom case so as to cover at least a part of the antenna module;

wherein the packing member is compressed such that elastic force of the packing member reinforces engagement between the top case and the bottom case when the first engagement part and the second engagement part are engaged with each other.

2. The antenna device according to claim 1, wherein:

the first engagement part includes a recess on an inner face of the top case, and an engagement member provided in the recess.

3. The antenna device according to claim 2, wherein a hole to be engaged with the engagement member is formed with the second engagement part.

4. The antenna device according to claim 1, wherein at least one of the first engagement part and the second engagement part is shaped so as to have a guide face which facilitates the engagement between the first engagement part and the second engagement part.

5. The antenna device as recited in claim 4, wherein said guide face includes an inclined part.

* * * * *